US011793729B2

(12) United States Patent
Lee

(10) Patent No.: US 11,793,729 B2
(45) Date of Patent: Oct. 24, 2023

(54) TEETHER WITH WRISTBAND

(71) Applicant: Seokjin Lee, Yangju-si (KR)

(72) Inventor: Seokjin Lee, Yangju-si (KR)

( * ) Notice: Subject to any disclaimer, the term of this patent is extended or adjusted under 35 U.S.C. 154(b) by 349 days.

(21) Appl. No.: 17/269,929

(22) PCT Filed: Oct. 24, 2018

(86) PCT No.: PCT/KR2018/012619
§ 371 (c)(1),
(2) Date: Feb. 19, 2021

(87) PCT Pub. No.: WO2020/045735
PCT Pub. Date: Mar. 5, 2020

(65) Prior Publication Data

US 2021/0322282 A1 Oct. 21, 2021

(30) Foreign Application Priority Data

Aug. 31, 2018 (KR) ..... 10-2018-0103457

(51) Int. Cl.
*A61J 17/00* (2006.01)
*A61J 17/02* (2006.01)

(52) U.S. Cl.
CPC ..... *A61J 17/1115* (2020.05); *A61J 17/02* (2013.01); *A61J 17/111* (2020.05)

(58) Field of Classification Search
CPC ..... A61J 17/02; A61J 17/111; A61J 17/1115; A44C 5/0007; A44C 5/0023; A44C 5/12
See application file for complete search history.

(56) References Cited

U.S. PATENT DOCUMENTS 6,243,921 B1 * 6/2001 Chang ..... A61J 17/111 24/3.13
2013/0014351 A1 1/2013 Kuglen et al.
2019/0388304 A1 * 12/2019 Lee ..... A44C 5/0023

FOREIGN PATENT DOCUMENTS

KR 20120052114 A 5/2012
KR 101838275 B1 3/2018
KR 200486034 Y1 3/2018

OTHER PUBLICATIONS

International Search Report of PCT/KR2018/012619, dated May 27, 2019, English translation.
Naver Cafe. Retrieved from https://cafe.naver.com/sanmoschool/401716, Feb. 12, 2018.
Naver blog, Retrieved from https://blog.naver.com/no1eunja/221149063842, Nov. 26, 2017.

* cited by examiner

*Primary Examiner* — Todd J Scherbel
(74) *Attorney, Agent, or Firm* — STIP Law Group, LLC

(57) ABSTRACT

An objective of the present disclosure is to provide a teether, wherein the teether is prevented from twisting when the circumferential length of a band thereof worn around the wrist of an infant is adjusted so as to not harm the body of the infant and a comfortable fit around the wrist is ensured.

6 Claims, 12 Drawing Sheets

(a)

(b)

TEETHER WITH WRISTBAND

CROSS-REFERENCE TO RELATED APPLICATIONS

This application is the U.S. National Phase under 35 U.S.C. § 371 of International Application No. PCT/KR2018/012619 filed on Oct. 24, 2018, which in turn claims the benefit of Korean Application No. 10-2018-0103457 filed on Aug. 31, 2018, the disclosures of which are incorporated by reference into the present application.

TECHNICAL FIELD

A deciduous tooth begins to rise with a bottom front tooth in 6- to 8-month-old infants and the entire tooth is completed over about two years. There is no sign of teething in sight at birth but many teeth are positioned in a jawbone in advance of birth and at teething time, the deciduous tooth begins to rise with the bottom front tooth in 6- to 8-month-old infants and the entire set of teeth is completed over about two years. There is no sign of teething in sight at birth but many teeth are positioned in a jawbone in advance of birth and at teething time, the deciduous teeth rise one by one. The infants feel pleasure in stimuli around the oral cavity, such as mouth, lips, tongue, gums, etc. in at the time of eruption of deciduous teeth, and this time is referred to as an oral phase. That is, since behaviors such as sucking, chewing, gnawing, etc. may be important for giving pleasure to infants in the oral phase, the stimuli around an oral cavity may use the infants' energy and soothe the tension.

Meanwhile, a general teether is a toy given to the infants to help satisfy the infants' instinctive desire to chew in the above-described oral phase, and promote visual, tactile, and intelligent physical development and tooth development.

Such a teether is available in various forms depending on the preferences, such as being mainly embodied in the form of a doll to arouse the infants' interest, or a band that may be used worn around a wrist to assist in grip of the infants lacking in somatesthesia.

In this way, the teether in the form of a band keeps a dominant market share due to several advantages, such as not easily slipping through hands of the infants and being safely usable.

The teether in the form of the band is provided with an adjustment member for adjusting a circumferential length in accordance with the wrist of the growing infants, and a relatively thinner portion of the adjustment member is broken when an infant repeatedly chew and suck the portion, and the portion may go beyond the back of a throat, causing a safety accident.

The adjustment member is generally and long in order to be easily worn on the wrist and to easily adjust the circumferential length, so even if the portion is not broken, there is a risk of damaging the pharyngeal mucosa when putting the portion into an infant's mouth.

In addition, since a general teether is made of soft synthetic resin, rubber, silicone materials, etc., a body part of the teether is easily twisted and is deformed in the process of adjusting the circumferential length using the adjustment member. As a result, there have been problems in a used structure that a corner portion of the adjustment member would give pressure on the infant's wrist, which may irritate skin of the infant's wrist or cause discomfort in wearing.

RELATED ART DOCUMENT

Patent Document

Korean Patent Application Publication No. 10-2012-0052114

SUMMARY

Technical Problem

The disclosure has been made to solve the above-mentioned problems in the related art, and is to provide a teether, wherein the teether is prevented from twisting when the circumferential length of a band thereof worn around a wrist of an infant is adjusted so as to not harm the body of the infant and a comfortable fit around the wrist is ensured.

In addition, the disclosure is to provide the teether capable of preventing parts which an infant may insert into his/her oral cavity from going beyond the back of his/her throat and causing vomit or accidents such as throat injury, pharyngeal mucosal injury, respiratory distress, etc.

Additionally, the disclosure is to provide the teether which may be vertically stored, thereby preventing contamination by contacting with the ground during storage, being storing hygienically, and having no need to be cleaned up for re-use.

Technical Solution

In order to achieve the above-mentioned aspect, the disclosure is characterized by including: a band having a cutout portion to allow a wrist of an infant to pass through and with a fastening hole at one end; a fastening piece arranged alternating one or more connecting rods and one or more fastening protrusions from the other end of the band, the fastening piece extending to be bent at least once and being engaged passing through the fastening hole to close the band; and a body part formed to extend up from the band to be allowed to be sucked, chewed and gnawed by the infant, wherein the fastening protrusions are formed with a cutoff slot so as to induce elastic deformation of the fastening piece to be prevented from twist deformation in the band when the fastening piece is engaged with the fastening hole.

In addition, the teether is characterized in that the fastening protrusions include a first fastening protrusion disposed at a given interval from the other end of the band; and a second fastening protrusion disposed at the given interval up from the first fastening protrusion, and the cutoff slot is formed in the first fastening protrusion.

In addition, the teether is characterized in that the fastening protrusions further include a third fastening protrusion disposed at the given interval in front of the second fastening protrusion, and the first fastening protrusion, the second fastening protrusion, and the third fastening protrusion is mutually arranged in an upside-down "L" shape.

In addition, the teether is characterized in that the fastening protrusions further include a third fastening protrusion disposed at the given interval up from the second fastening protrusion, and at least one among the second fastening protrusion and the third fastening protrusion is eccentric on a vertical line of the first fastening protrusion such that the fastening piece has a certain inclined angle.

In addition, the teether is characterized in that the cutoff slot is cut off facing outward from a center of the fastening protrusion.

In addition, the teether is characterized in that the fastening hole is integrally formed with a through-section through which the fastening protrusion is passed and an extension section extending from the through-section so that the through-section may extend in accordance with the size of the fastening protrusion.

Advantageous Effects

The present disclosure has the following effects:

First, since the fastening piece is freely deformed relative the cutoff slot in the process of manipulating the fastening pieces, it is possible to adjust the circumferential length of the band 10 to the extent that the band and the body part do not twist. As a result, it is possible to prevent from irritating the infant's wrist due to the twisting of the band, and to provide an excellent feeling of wearing the band.

Second, since the fastening piece has a rolled-up form, it is possible to stop the fastening piece from being easily inserted into the infant's mouth, and even if the fastening piece is inserted into the mouth, to prevent a safety accident by stopping the same from going deep into the infant's throat.

Thirdly, the disclosure is to provide the teether which may be vertically stored, thereby preventing contamination by contacting with the ground during storage, being stored hygienically, and having no need to be cleaned up for re-use.

BRIEF DESCRIPTION OF THE DRAWINGS

FIG. 3A is a view illustrating an overall appearance of the teether to which a second embodiment of the fastening piece is applied according to the disclosure and.

DETAILED DESCRIPTION

Figure 1:
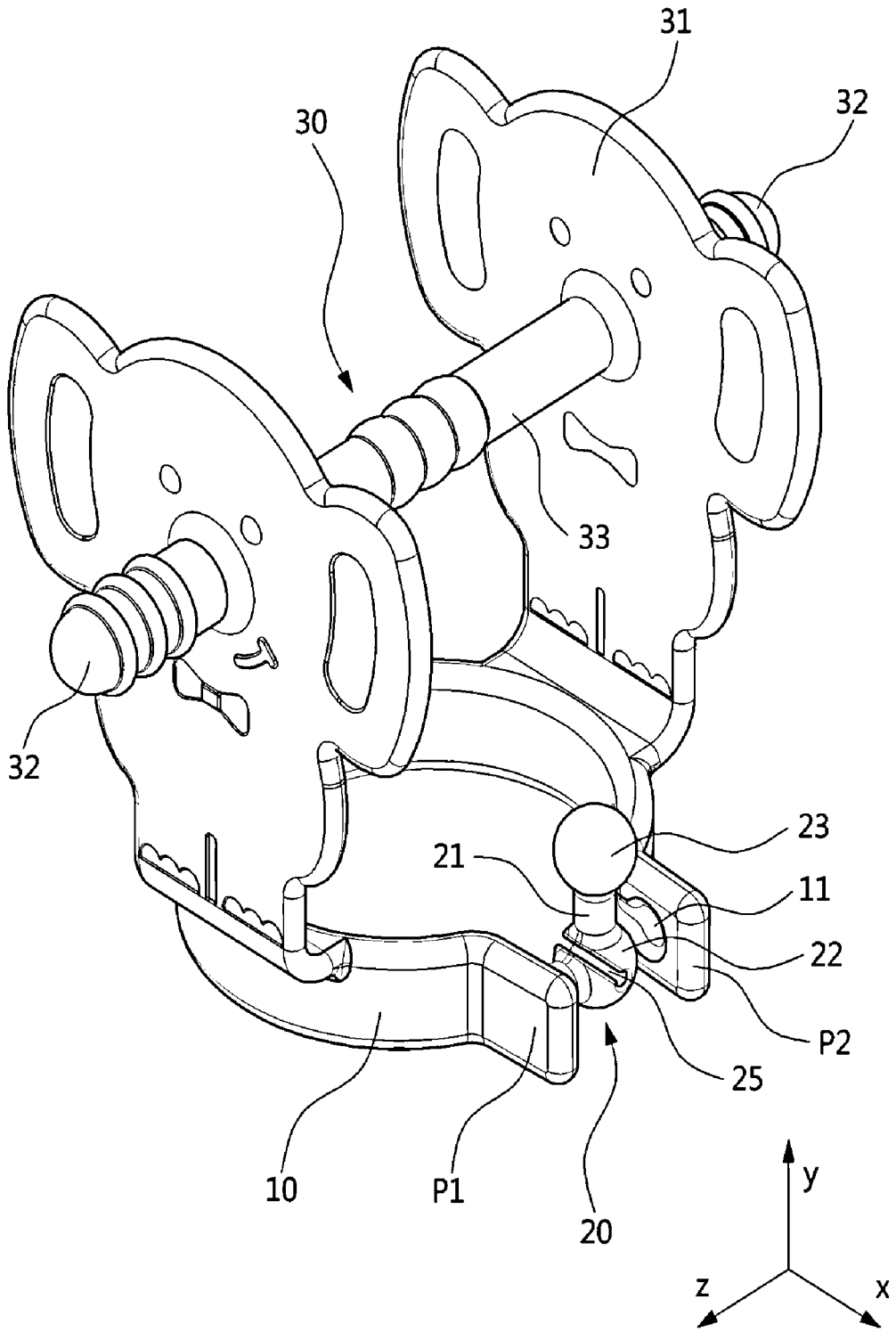
FIG. 1 is a view illustrating an overall appearance of a teether to which a first embodiment of a fastening piece is applied according to the disclosure.

Preferred embodiments of the disclosure will now be described with reference to the accompanying drawings to provide a thorough understanding of the disclosure. The embodiments may be modified in various forms, and the scope of the disclosure should not be construed as limited to the embodiments described in detail below. The embodiments are provided to more fully explain the disclosure to one of ordinary skill in the art. Accordingly, shapes and the like of elements in the drawings may be presented greatly exaggerated in order to highlight the more clarifying explanation. It is to be noted that the same elements in each of the drawings are sometimes denoted by the same reference numerals. Detailed descriptions of well-known functions and configurations that are deemed to unnecessarily obscure the subject matter of the disclosure are omitted.

The components constituting the teether according to the disclosure are preferably all integrally formed as shown in the drawings, and all formed from curved outer surfaces for safe use by an infant. The same may also be made of various materials, but is preferably made of resilient synthetic resin, silicone, rubber materials, etc. that has been sanitized because the same would enter the infant's mouth. Herein, the members each may also be formed from materials each having different hardness from each other.

The teether according to the disclosure may be used stably due to a simple integrated structure, may be preferably monolithic to improve hygiene management, and may minimize a radius of detaching from the infant's hand to minimize contaminate the teether.

Before further explanation, to specify a reference of orientation not static based on FIG. 1, the upward-downward directions (y), the forward-rearward directions (z), and the leftward-rightward directions (x) are set as shown in FIG. 1 and the description of the other drawings follows such reference of orientation.

As shown in FIG. 1, the teether according to the disclosure is defined as including a band 10 having a cutout portion to allow a wrist of an infant to pass through and with a fastening hole 11 at one end, a fastening piece 20 arranged alternating one or more connecting rods 21 and one or more fastening protrusions from the other end of the band 10, the fastening piece extending to be bent at least once and being engaged passing through the fastening hole 11 to close the band 10, and a body part 30 formed to extend up from the band 10 to be allowed to be sucked, chewed and gnawed by the infant.

First, the band 10 is a part to be wrapped around the wrist of the infant and formed in a ring shape, such as a circular ring shape, an elliptical ring shape, etc., and may be used by varying the orientation of the teether as needed without necessarily wearing the band 10 on the wrist of the infant, and thus gripped in several ways.

The band 10 may be widely used since the band 10 is formed from a resilient material to be elastically deformed to a relatively larger wrist circumference of the infant or the increased wrist circumference as the infant grow up, and may be worn smoothly on thick clothes.

Since the band 10 is broken at a portion on a path, it is possible to make the wrist of the infant pass through the band 10 without any interference, and wearing the band 10 on the wrist of the infant causes a certain clamping force to be exerted by an elastic restoring force of the band 10 itself.

Meanwhile, a first flange F1 and a second flange F2 may be formed at one end and the other end of the band 10, respectively. The first flange F1 and the second flange F2 are embodied in a shape that both ends of the band are bent and then extend a certain length.

If the band 10 is to be worn on the relatively larger wrist circumference of the infant, the belt 10 extends in accordance with the larger wrist circumference and the clamping force is caused by elastic restoration of the band 10, such that the teether is not detached from a body of the infant. It is necessary, however, that one end and the other end of the band 10, i.e., the first flange F1 and the second flange F2 be interjoined and clamped for stability purposes. To this end, the fastening hole 11 and the fastening piece 20 are formed at one end and the other end of the band 10, respectively.

In particular, the fastening piece 20 has such a structure that, in addition to functioning to close the band 10, the infant does not insert the fastening piece 20 into his/her oral cavity, and the body part 30 does not twist when the fastening piece 20 is manipulated to insert into the fastening hole 11.

To this end, the fastening piece 20 is illustrated in which the fastening protrusions are formed with a cutoff slot 25 so as to induce elastic deformation of the fastening piece to avoid twist deformation in the band 10 when the fastening piece 20 is engaged with the fastening hole 11.

The cutoff slot 25 is embodied in a form of a portion of the fastening protrusion being cut off facing outward from a center of the fastening protrusion, and has a deformable structure in which the fastening piece 20 is deformed and then elastically restored, relative to the cutoff slot 25.

Meanwhile, it is preferable that the connecting rods 21 function to interconnect the other end of the band 10 and the fastening protrusion, or adjacent fastening protrusions, and have a relatively smaller width compared to adjacent fastening protrusions. The fastening protrusions serve to allow one end and the other end of the band 10 to remain joined passing through the fastening hole 11, and may be embodied in any shape, including, but is not limited to a sphere, an ellipse, a polygon, a geometry, etc.

Figure 3A:
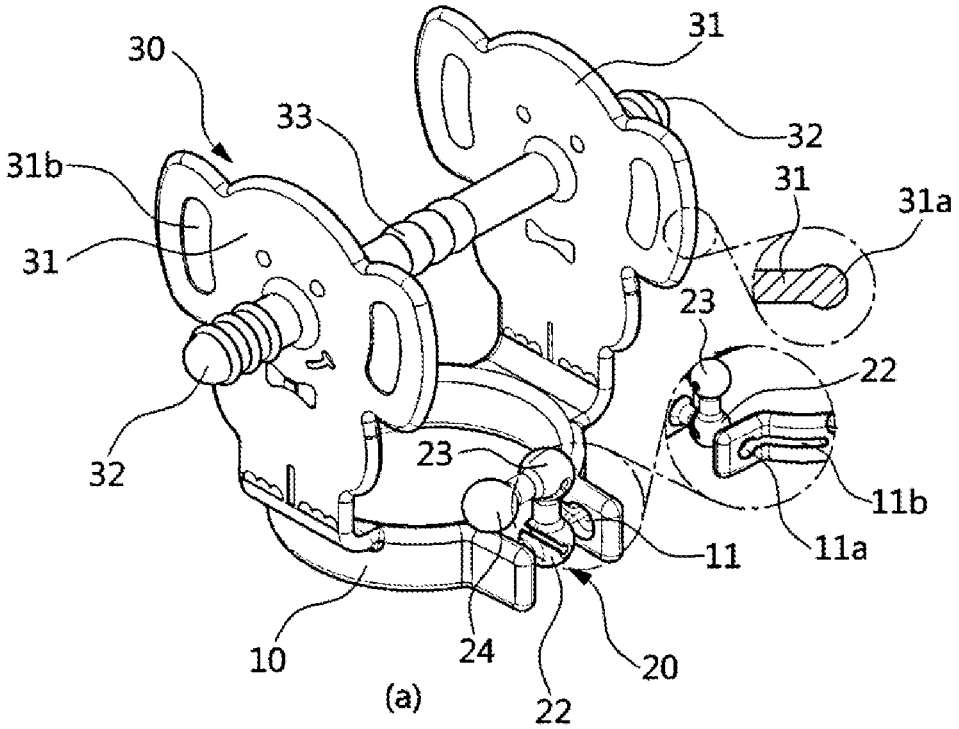

As shown in FIG. 3A, the fastening hole 11 may be embodied in a shape of a long groove extending along a longitudinal direction of the band 10 from one end of the band 10, and in particular, it may be defined that the fastening hole is integrally formed with a through-section 11*a* through which the fastening protrusion is passed and an extension section 11*b* extending from the through-section 11*a* so that the through-section 11*a* may flexibly extends in accordance with a size of the fastening protrusion.

Embodiments of the fastening piece 20 may depend on a direction in which the fastening protrusions are arranged. First, a first embodiment of the fastening piece 20 will be described with reference to the accompanying drawings as follows. FIG. 1 illustrates the fastening piece 20 in which the fastening protrusions include a first fastening protrusion 22 disposed at a given interval from the other end of the band 10, and a second fastening protrusion 23 disposed at the given interval up from the first fastening protrusion 22. Herein, the connecting rods 21 are formed between the other end of the band 10 and the first fastening protrusion 22 and between the first and second fastening protrusions 22 and 23, respectively, and the cutoff slot 25 is formed in the first fastening protrusion 22.

Figure 2A:
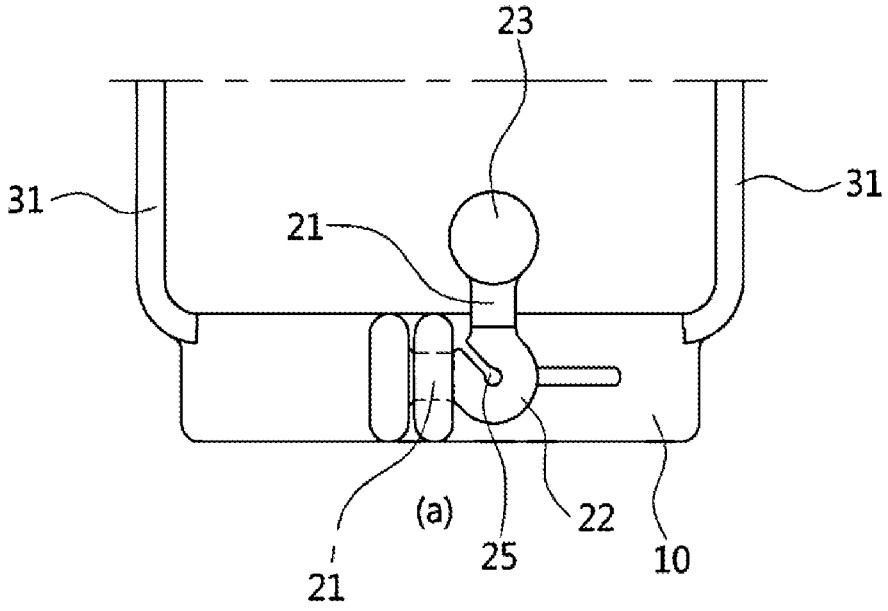
FIGS. 2A and 2B are views illustrating concepts of the fastening piece as shown in FIG. 1.

As shown in FIG. 2A, the fastening piece 20 is bent in a substantially reverse "L" shape in which the first and second fastening protrusions 22 and 23 are disposed so as to be spaced apart from each other in the upward-downward directions, and the protrusions are disposed on the same vertical line. This contributes to the improved joining and clamping force of one end and the other end of the band 10, which serves as an advantage that keeps the band 10 from getting loosened easily once the band 10 is worn on the infant's wrist.

Figure 2B:
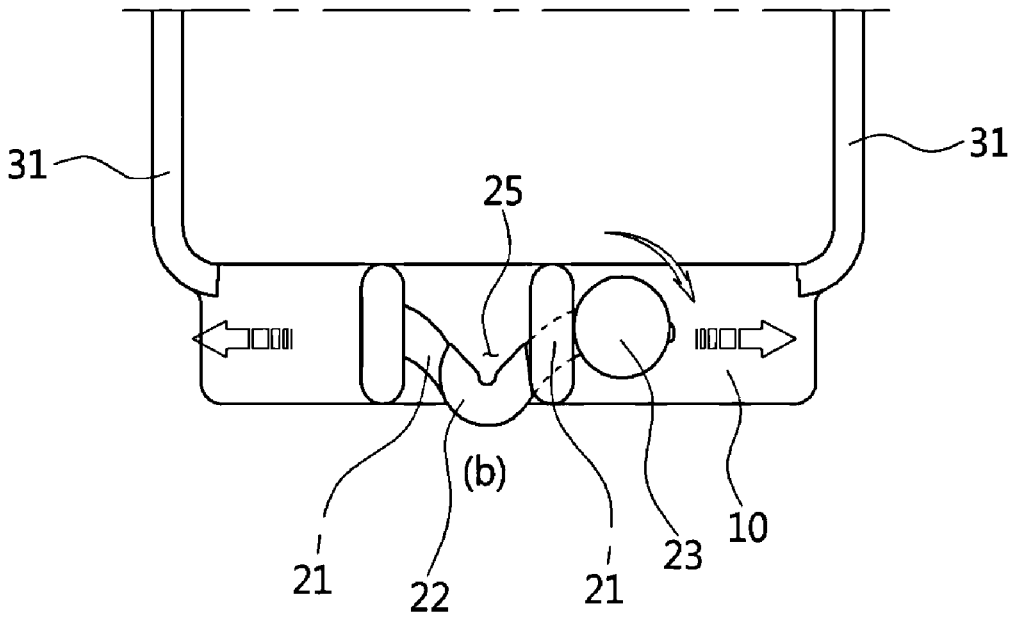

Meanwhile, if the band 10 is to be worn on the relatively larger wrist circumference of the infant, only the second fastening protrusion 23 pass through the fastening hole 11 to extend the circumferential length of the band 10, as shown in FIG. 2B. Herein, the fastening piece 20 is deformed relative to the cutoff slot 25 to assist in preventing a form of the band 10 or the body part 30 from twisting.

In the teether integrally made of soft synthetic resin, rubber, silicone materials, etc., the band 10 and the body part 30 would be subjected to twist deformation in the process of adjusting the circumferential length of the band 10. In the event that the band 10 were being worn on the infant's wrist and to be twist, there has been a problem that would give pressure on the infant's wrist, which may irritate skin of the infant's wrist or cause discomfort of wearing.

On the other hand, in the teether according to the disclosure, since the fastening piece 20 is freely deformed relative the cutoff slot 25 in the process of manipulating the fastening pieces 20, it is possible to adjust the circumferential length of the band 10 to the extent that the band 10 and the body part 30 do not twist.

Figure 3B:
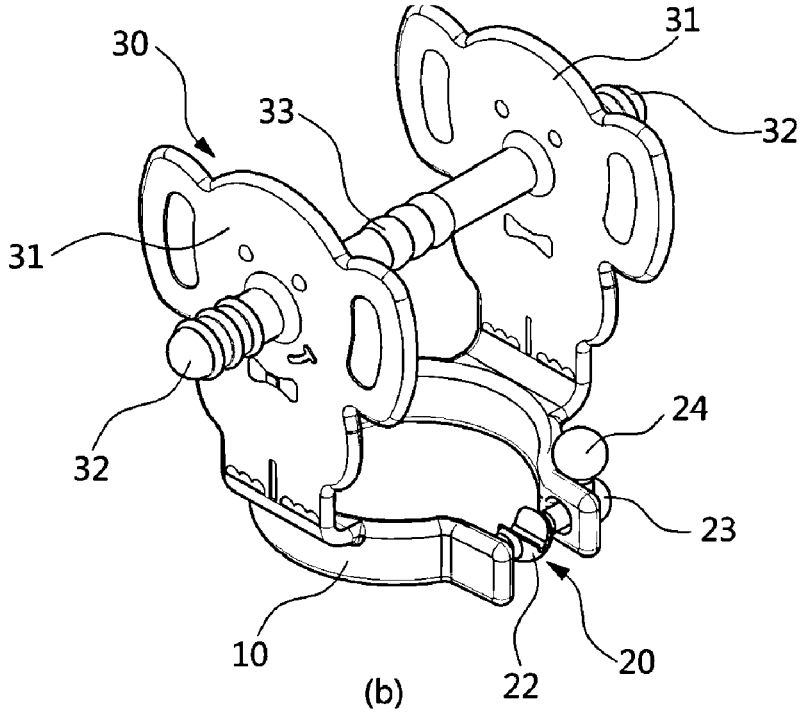
FIG. 3B is a view illustrating a state in which the fastening piece is fastened in the teether of FIG. 3A.

FIGS. 3A and 3B is a diagram illustrating the teether to which a second embodiment of the fastening piece 20 is applied, which suggests the same technical contents as the embodiment discussed above except that the fastening protrusions further include a third fastening protrusion 24 in the embodiment of the fastening piece 20. Hereinafter, the second embodiment of the fastening piece 20 will be described with reference to the accompanying drawings.

Figure 4:
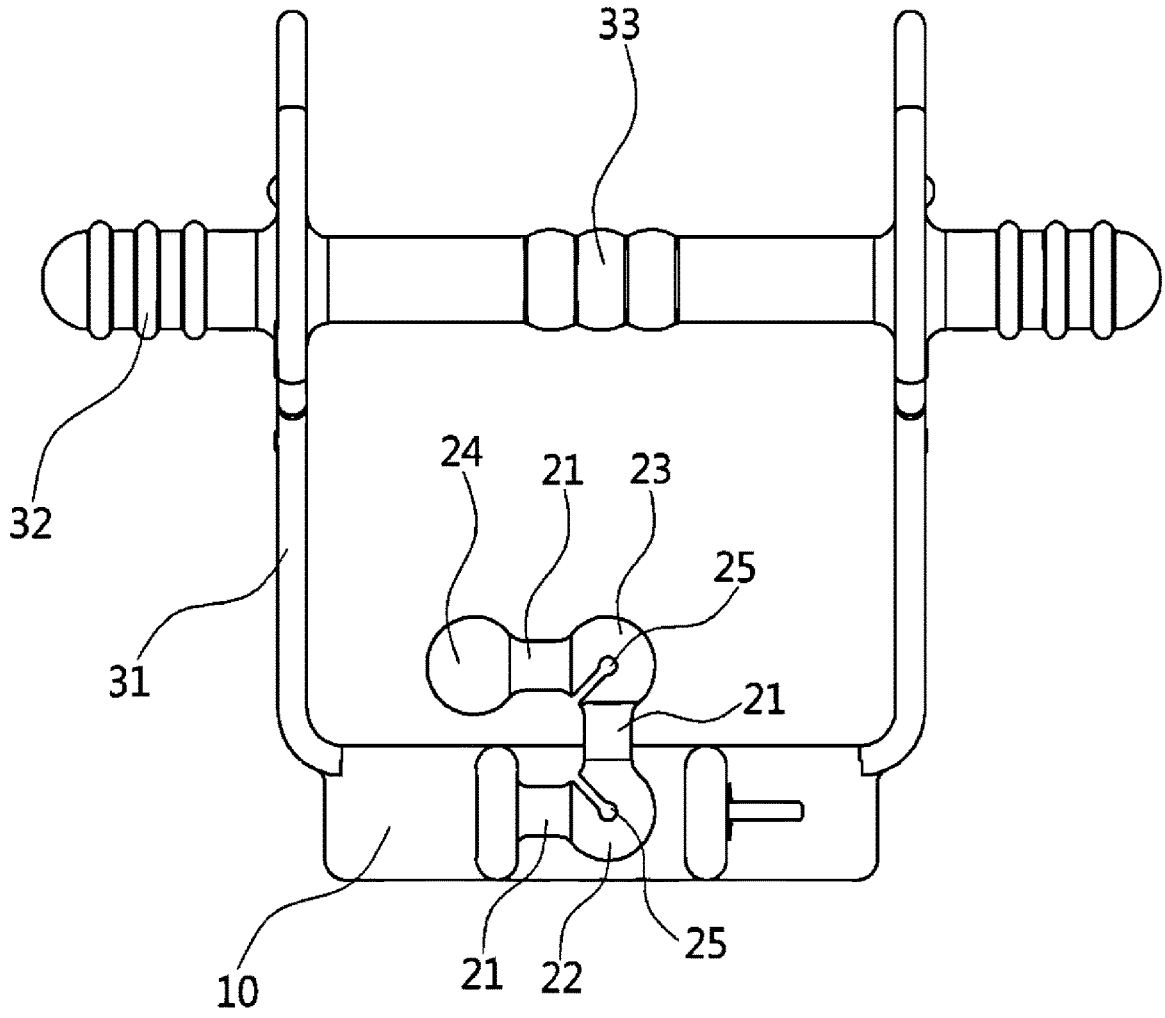
FIG. 4 is a view illustrating one side of the teether as shown in FIG. 3A.
Figure 5:
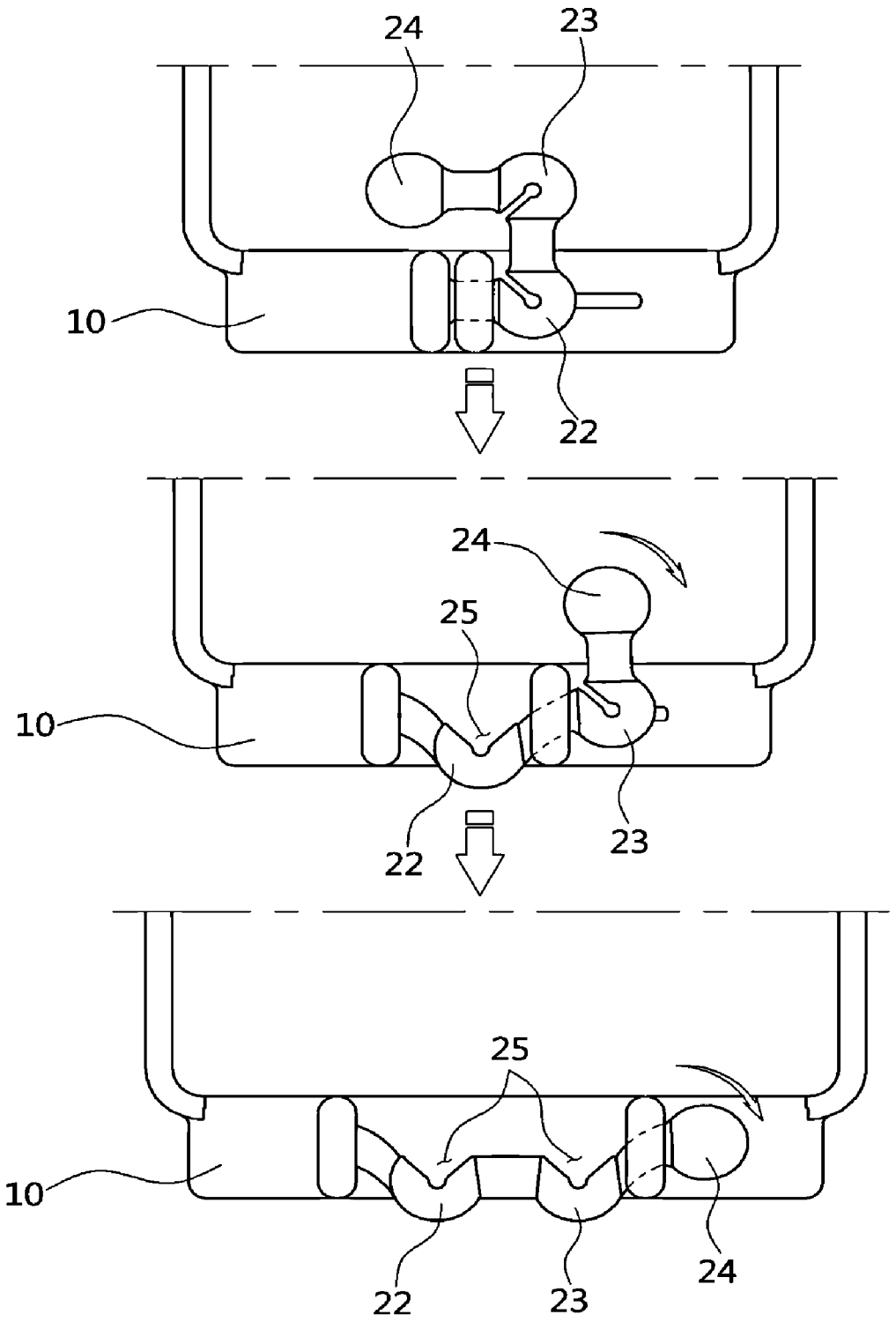
FIG. 5 is a view illustrating an example in which the circumferential length of a band of the teether shown in FIG. 3A gradually extends.

As shown in FIGS. 3 and 4, the fastening protrusions may be defined including a first fastening protrusion 22 disposed at a given interval from the other end of the band 10, a second fastening protrusion 23 disposed at the given interval up from the first fastening protrusion 22, and a third fastening protrusion 24 disposed at the given interval in front of the second fastening protrusion 23. Herein, the cutoff slot 25 is preferably formed in at least one among the first fastening protrusion 22 and the second fastening protrusion 23.

The first fastening protrusion 22, the second fastening protrusion 23, and the third fastening protrusion 24 is mutually arranged in an upside-down "L" shape, so the fastening piece 20 itself has a form of being bent at least once and rolled. As such, since the fastening piece 20 has a rolled-up form, it is difficult for the infant to easily insert the fastening piece 20 into his/her mouth, and even if the fastening piece 20 is inserted into the oral cavity, the fastening piece 20 may not go deep into the infant's throat and there is no fear of damaging soft tissue in the oral cavity, because fastening piece 20 is rolled up.

In general, in addition to inserting the body part 30 into the oral cavity, infants are fond of inserting anything the infants could grab in their hands, such as the band 10, the fastening piece 20, etc. into their mouths, which when the infants repeatedly gnaw or suck the fastening piece 20 that is provided to function to clamp to the band 10, not to be inserted into their mouths, would lead to fatal accidents swallowing the same being ruptured as a result of fatigue.

For these reasons, the fastening piece 20 of the teether according to the disclosure has such a structure as described above, thereby making it possible to prevent the fastening piece 20 from being easily inserted into the mouth, and even if the fastening piece 20 is inserted into the mouth, a safety accident is prevented by preventing the fastening piece 20 from going deep into the infant's throat.

Next, a third embodiment of the fastening piece 20 will be described with reference to the accompanying drawings.

Figure 6:
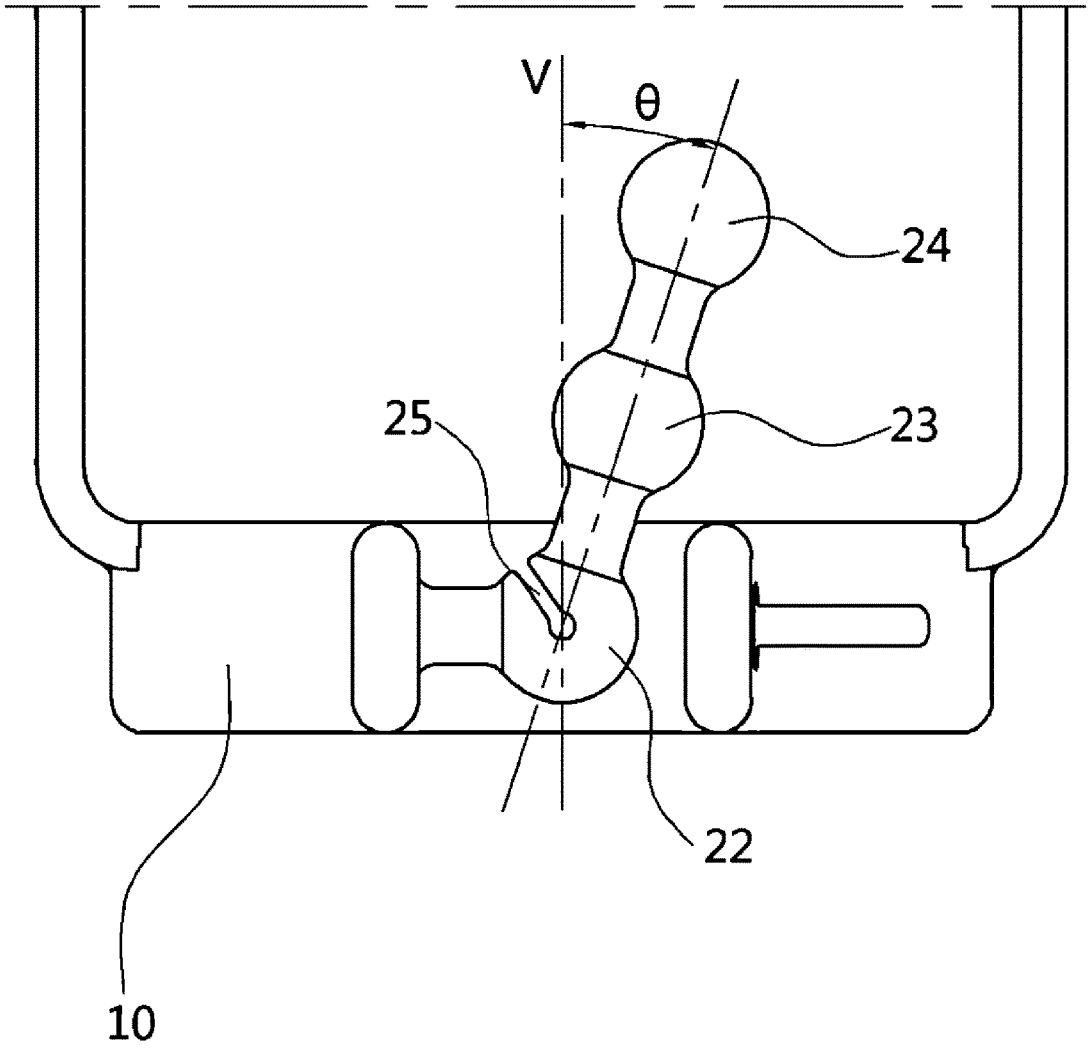
FIG. 6 is a view illustrating a portion of the teether to which a third embodiment of the fastening piece is applied according to the disclosure.

As shown in FIG. 6, the fastening protrusions may be defined including a first fastening protrusion 22 disposed at a given interval from the other end of the band 10, a second fastening protrusion 23 disposed at the given interval up from the first fastening protrusion 22, and a third fastening protrusion 24 disposed at the given interval up from the second fastening protrusion 23, and at least one among the second fastening protrusion 23 and the third fastening protrusion 24 has an eccentric form on a vertical line V of the first fastening protrusion 22 such that the fastening piece 20 has a certain incline angle θ. Herein, the incline angle θ of the fastening piece 20 is preferably set within an angular range of 1° to 80°.

The fastening piece 20 in the present embodiment is characterized by being inclined in a substantially oblique direction through the eccentric arrangement of the fastening protrusions.

Figure 7:
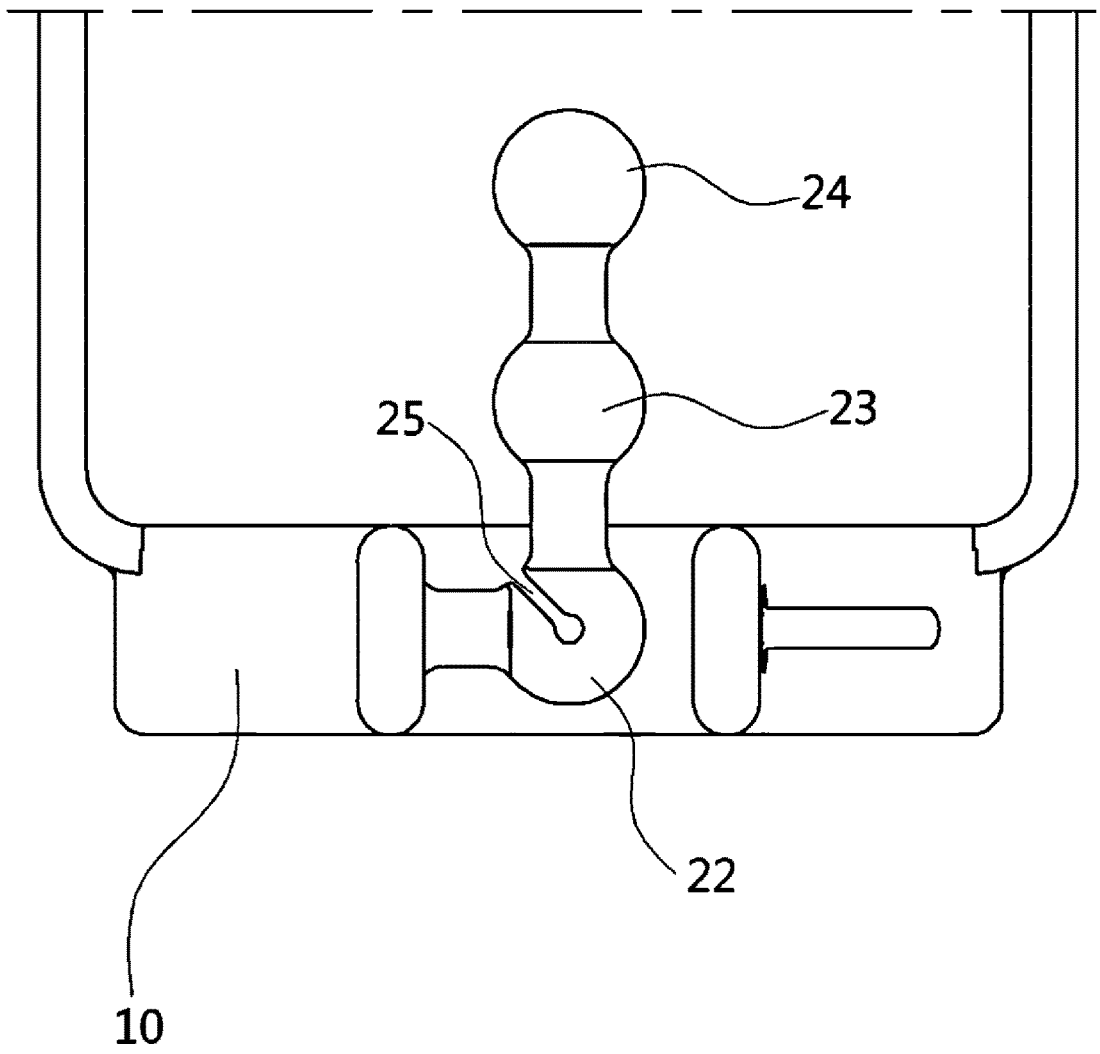
FIG. 7 is a view illustrating the portion of the teether to which a fourth embodiment of the fastening piece is applied according to the disclosure.

Next, a fourth embodiment of the fastening piece 20 will be described with reference to FIG. 7. The present embodiment illustrates the fastening protrusions in which the first, second and third fastening protrusions 22, 23 and 24 are disposed on single vertical line with being spaced apart from each other in the upward-downward directions.

Figure 8:
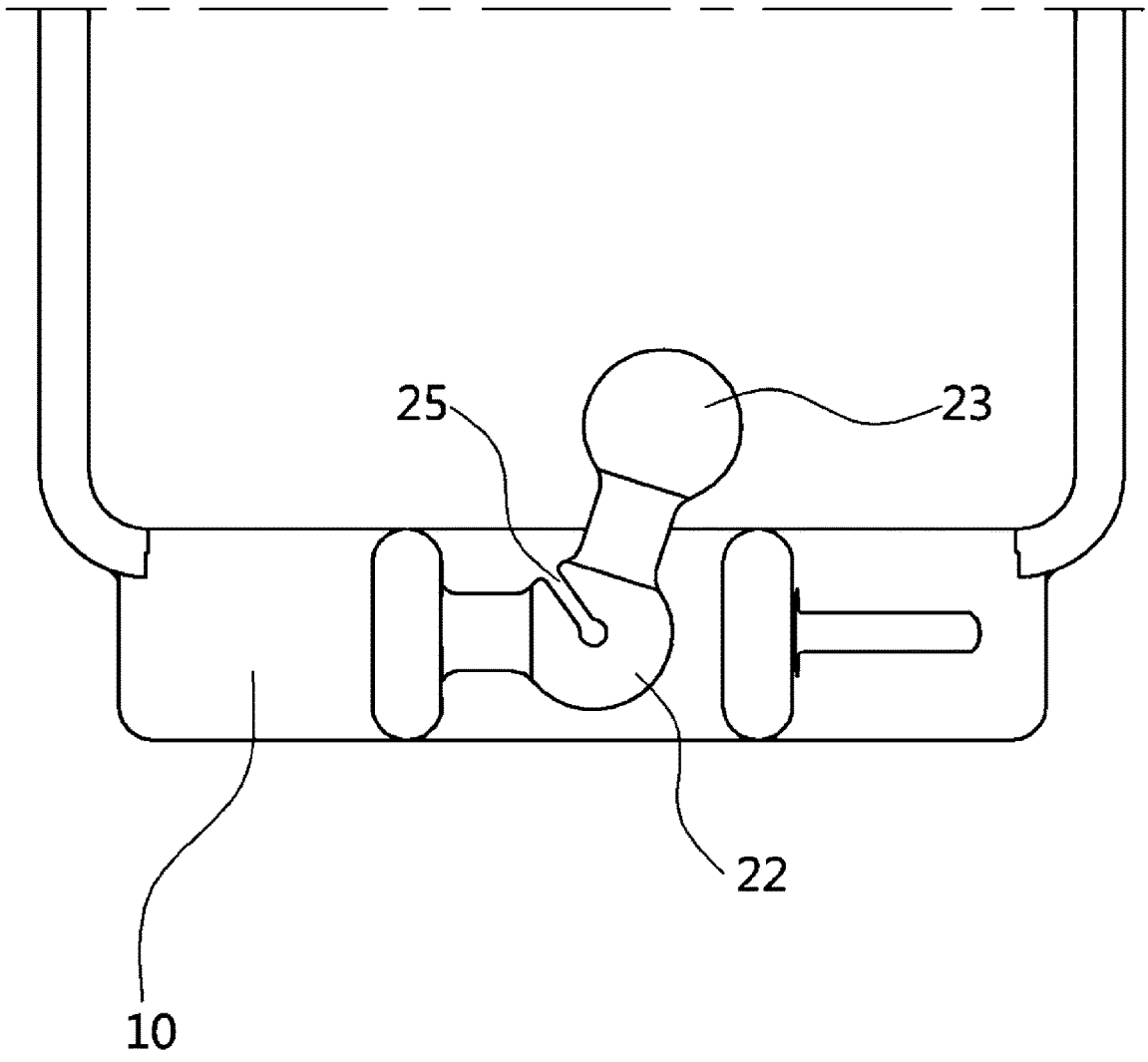
FIG. 8 is a view illustrating the portion of the teether to which a fifth embodiment of the fastening piece is applied according to the disclosure.

Next, a fifth embodiment of the fastening piece 20 will be described with reference to FIG. 8. The fastening protrusion according to the present embodiment is similar to the above-described third embodiment, but illustrates the fastening protrusion with the third fastening protrusion 24 omitted.

Figure 9:
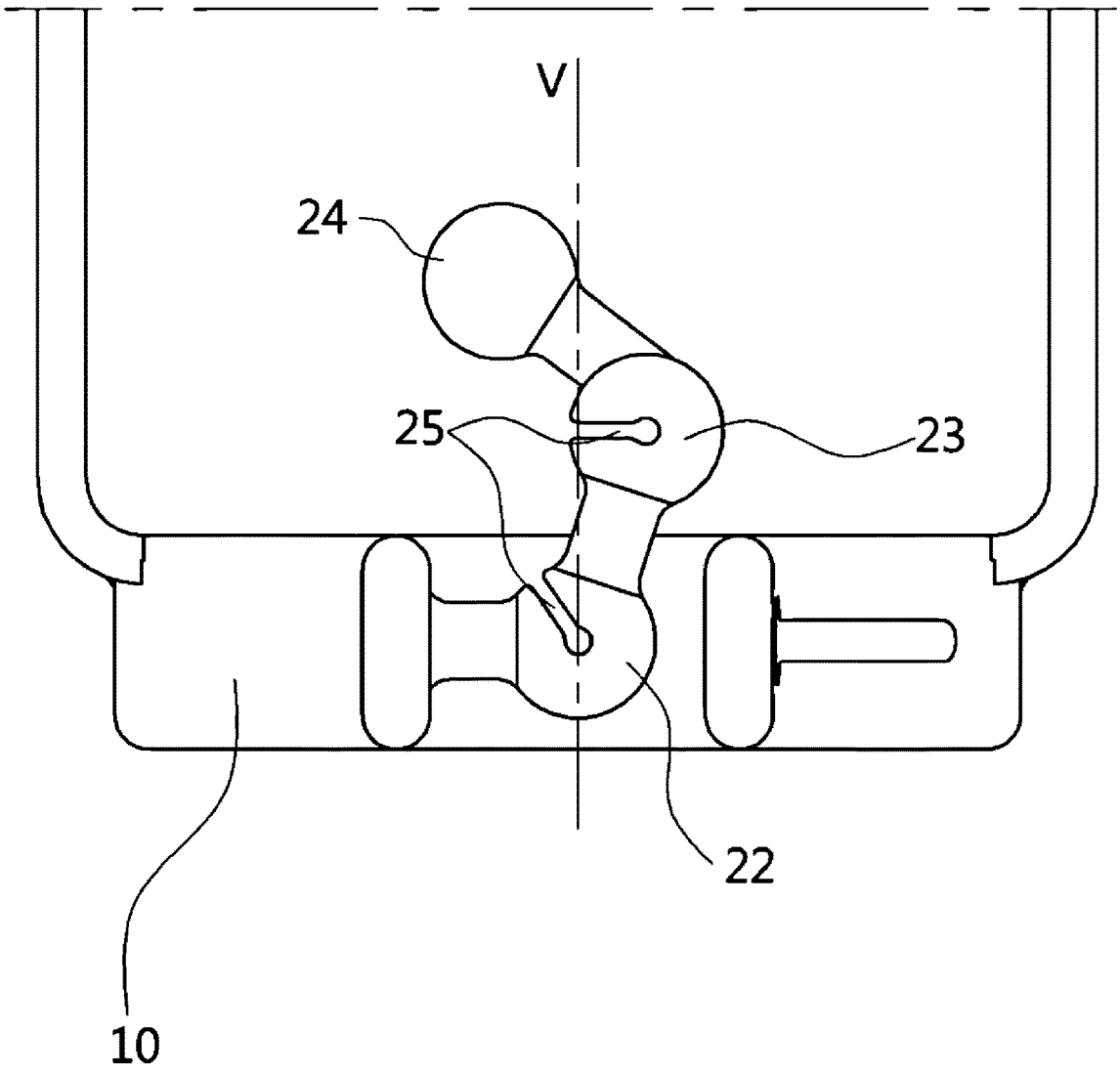
FIG. 9 is a view illustrating the portion of the teether to which a sixth embodiment of the fastening piece is applied according to the disclosure.

Next, a sixth embodiment of the fastening piece 20 will be described with reference to FIG. 9. The fastening protrusion according to the present embodiment has an arrangement structure in which the second fastening protrusion 23 spaced apart up from the first fastening protrusion 22 is spaced rearwards relative to the vertical line V and the third fastening protrusion 24 disposed up from the second fastening protrusion 23 is spaced forwards relative to the vertical line V. As a result, the fastening piece 20 may have a multi-directional bent shape.

Hereinafter, the body part 30 will be described with reference to the accompanying drawings. The body part 30 is a part directly inserted into the infants mouth, and the infant may feel pleasure by getting rid of tickling in the mouth and being exposed to various stimuli through behaviors of sucking, chewing or gnawing the body part 30. The body part 30 may has any form as long as the body part 30 may be put into the oral cavity of the infant, but an example thereof is as follows. First, the body part 30 shown in FIG. 1 includes a pair of swallowing-preventive members 31 each extending in an upward direction at 180 degrees out of phase around the band 10 and positioned parallel to each other so as to face each other and having a shape of wide top and narrow bottom plate, a pair of projecting members 32 each protruding outwards from the pair of swallowing-preventive members 31, and A gripping portion 33 each fixed at both ends to each of the swallowing-preventive members 31 across two of the swallowing-preventive members 31 so as to be gripped by the infant's hands, characterized in that, when the infant sucks or chews the projecting members 32, any part of the teether is restricted from going beyond the back of the infant's throat by the swallowing-preventive members 31.

First, the swallowing-preventive member 31 is a thin plate-shaped member having a thickness of 1 mm to 10 mm, and is mainly responsible for applying stimuli lips of the infant. In addition, the shape of the swallowing-preventive member 31 may be employed in a variety of patterns that may arouse the infant's interest, and is not limited thereto.

Although the swallowing-preventive member 31 is described and illustrated as a plate-shaped member for convenience, it is to be understood that the swallowing-preventive member 31 may include a plate-shape having a curvature and the like the thickness thereof may be variously modified depending on infant age.

The swallowing-preventive member 31 is preferably embodied in the wide top and narrow bottom shape that becomes gradually wider toward the top in forward-rearward width to prevent from being go beyond the back of the throat when being sucked or chewed.

Further, it is preferable that the swallowing-preventive member 31 is embodied as being approximately 30 mm to 70 mm, more preferably 50 mm to 60 mm in the leftward-rightward width. This is to prevent the swallowing-preventive member 31 from being completely inserted into the oral cavity by forming larger than the size of the mouth when the infant opens his/her mouth as wide as possible.

This is because a lower portion of the teether is composed of a band 10, such that given the size of the infant's mouth, the band 10 cannot be inserted deep enough to enter the infant's mouth and irritate the back of the infant's throat, but an upper portion of the swallowing-preventive member 31 is in a completely open-topped form as opposed to a conventional teether, so if the leftward-rightward width of the swallowing-preventive member 31 is thin enough to facilitate the upper portion of the teether to enter the infant's mouth and irritate the back of the infant's throat, causing vomit. Accordingly, the disclosure has the open-topped form, and to solve the problem of irritate the back of the infant's throat that may occur in this case, the leftward-rightward width of the swallowing-preventive member 31 gets widened enough to prevent the teether from entering the infant's mouth. To this end, the swallowing-preventive member 31 of the disclosure has the wide top and narrow bottom form.

In other words, the swallowing-preventive member 31 becomes gradually wider toward the top in the width, thereby preventing from being inserted too deep when the swallowing-preventive member 31 is put into the infant's mouth.

Meanwhile, many different shapes of embossing, engraving, through-hole, patterns utilizing the same, etc. may be formed on surfaces of the swallowing-preventive member 31 so as to arouse the infant's interest.

Also, one or more lip dosing holes **31*b* may be made in the swallowing-preventive member 31** to recognize how to close the mouth allowing the infant's upper and lower lips to come into contact with each other.

Figure 10:
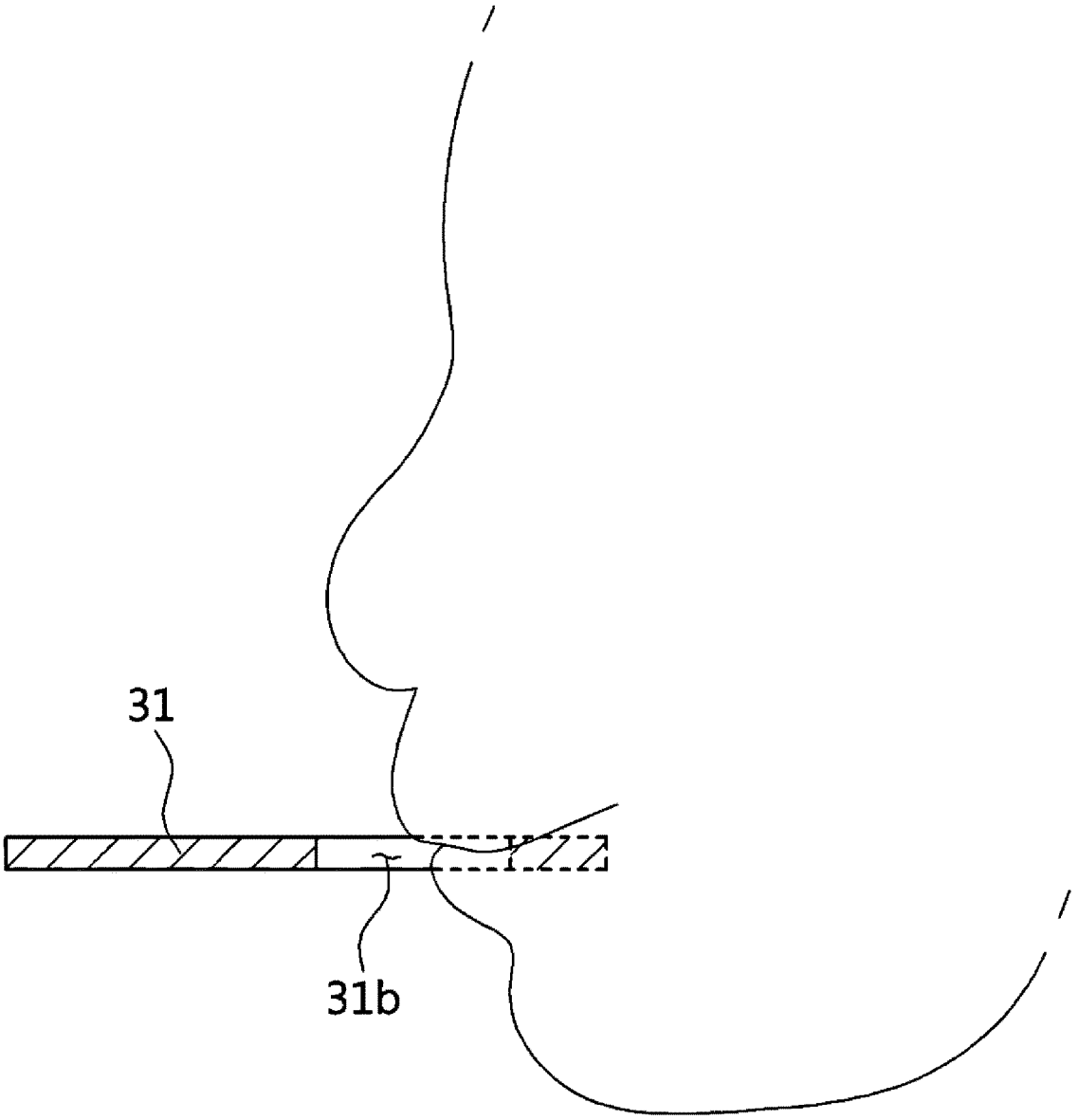
FIG. 10 is a view for explaining a function of a lip closing hole.

As shown in FIG. 10, the lip closing holes **31*b* may satisfy the infant's desire for sucking reflex by allowing the infant to suck the swallowing-preventive members 31** with the infant's upper and lower lips into contact with each other and also develop the infant's somatosensory function by self-stimulating their lips by closing their mouths.

Meanwhile, the above-described lip closing holes **31*b* are optional, and a plurality of protrusions (not shown) may protrude at a position where the lip closing holes 31*b* of the swallowing-preventive members 31 are located in a case where the lip closing holes 31*b*** are not formed.

Next, the projecting members 32 protrude outwards from the swallowing-preventive members 31 so that the behaviors of sucking, chewing, gnawing, etc. of the infant are intensively induced. As described above, although all of the members constituting the teether may be sucked, chewed, and gnawed, it is preferable to lead the infant to intensively suck, chew, and gnaw the projecting members 32. In this case, as an example of the projecting members 32, although the projecting members 32 are shown formed a plurality of stimulating protrusions in a rod shape in the accompanying drawings, it is to be noted that the shape thereof is not limited thereto.

In the case where the infant sucks, chews, and gnaws the projecting members 32, secretions such as saliva are continuously secreted. In this case, the secreted secretions are blocked by the swallowing-preventive members 31 and do not dribble directly down to the hands of the infant.

Thus, parents may easily keep up the infant's hygiene only needing to clean up the secretions from the swallowing-preventive members 31 without the need to continuously clean up the secretions from the infant's hands.

In addition, the swallowing-preventive members 31 function as a stopper for preventing the projecting members 32 from going completely beyond the back of the throat causing vomit or damaging to the pharyngeal mucosa when the infant sucks, chews, and gnaws the projecting members 32.

A reinforcement 31*a* thicker than the width of the swallowing-preventive member 31 may be wrapped around the swallowing-preventive member 31. The reinforcement 31*a* may help maintain the shape of the body part 30, and impart the volumetric stability to the band 10 and the swallowing-preventive members 31, thereby preventing breakage when the infant puts the same into his/her mouth and gnaw the same. That is, it is possible to prevent a portion of the teether from being broken and the infant from swallowing the same. Meanwhile, the reinforcement 31*a* may extend to the band 10, in addition to the swallowing-preventive members 31.

Figure 11A:
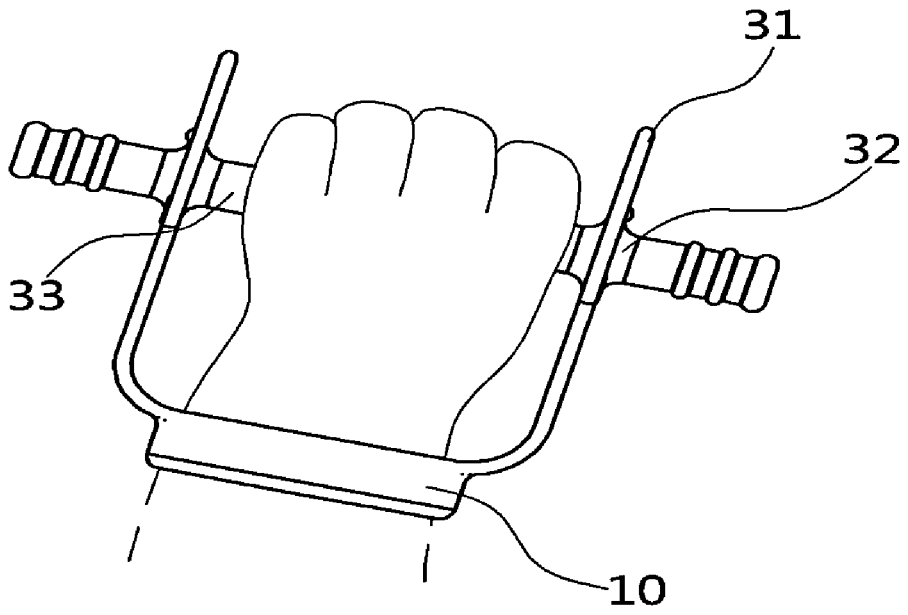
FIG. 11A and FIG. 11B are views schematically illustrating states of the use of the teether according to the disclosure.
Figure 11B:
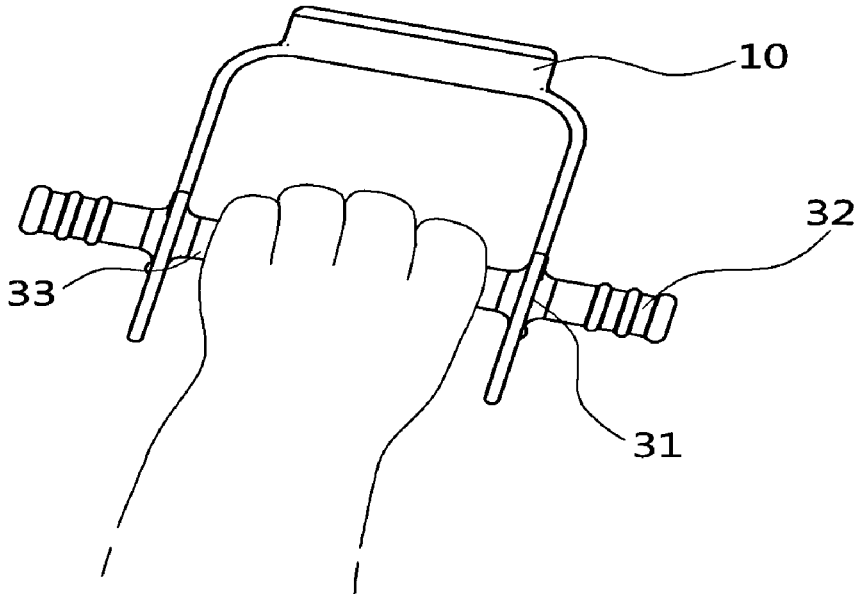

Employing the body part 30 shown in FIG. 1 allows to be used by varying the orientation of the teether as needed without necessarily wearing the band 10 on the wrist of the infant, and thus gripped in several ways when using the teether. As an example, as shown in FIG. 11A, the teether is generally used after the band 10 is worn on the wrist, a hand is interposed between the body parts 30, and then the gripping portion 33 is gripped. However, as shown in FIG. 11B, the teether may also be used without wearing the band 10 on the wrist of the infant. In this case, the infant may suck, chew and gnaw the band 10 while holding the gripping portion 33, and a stimulating member (not shown) may also protrude along an outer peripheral surface of the band 10 in order to maximize the stimulating effect around the oral cavity. The stimulating member may be embossing, engraving, through-hole, patterns utilizing the same, etc.

Figure 12:
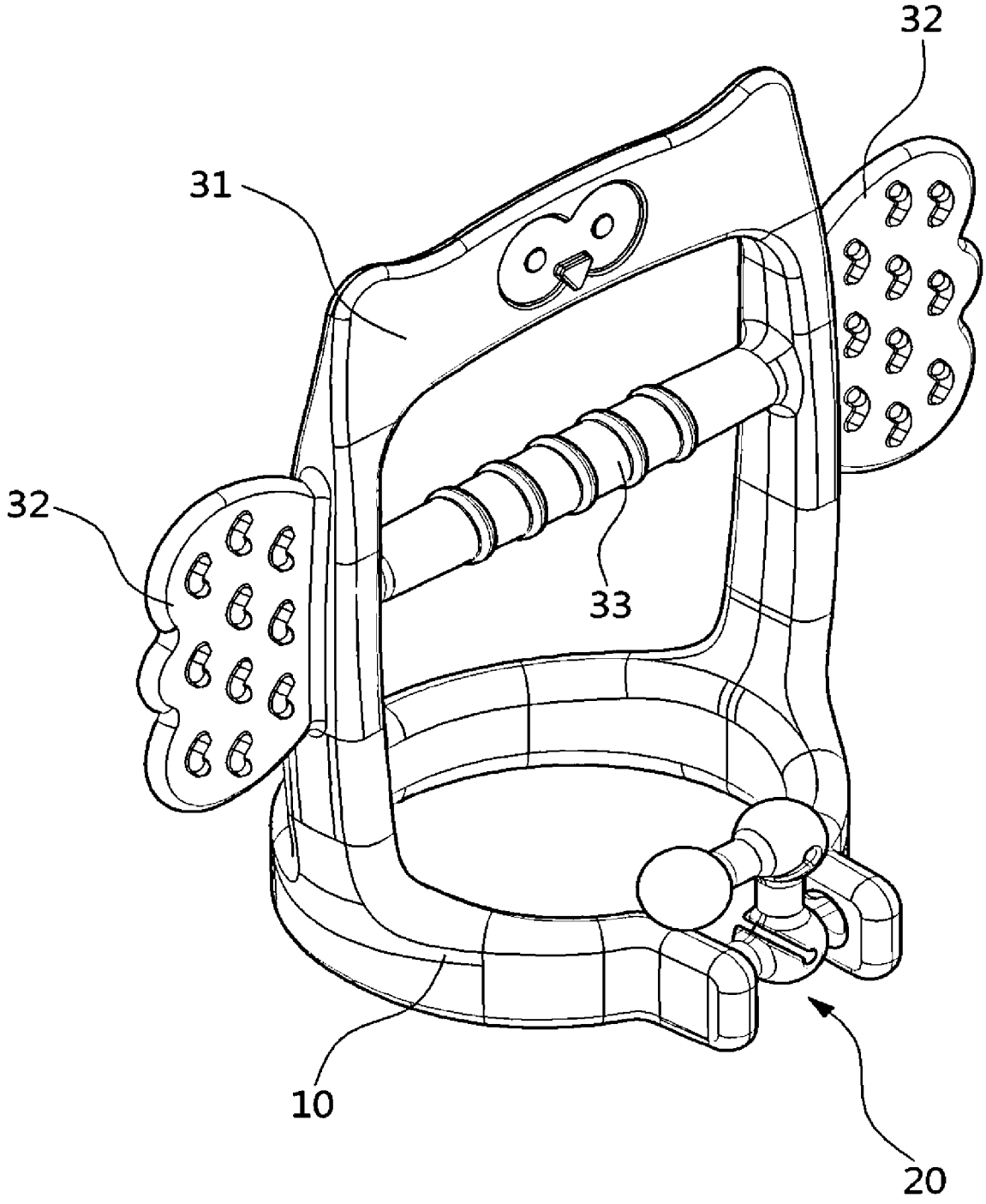
FIG. 12 is a view illustrating another embodiment of a body part.

Meanwhile, FIG. 12 is a diagram illustrating another embodiment of the body part 30, which is similar to that of FIG. 1, except that the upper portion of the swallowing-preventive member 31 is not opened but has a form of wrapping around the hand, so that detailed description will be omitted.

The above-described embodiments of the disclosure are merely exemplary, and it will be apparent to one of ordinary skill in the art that many modifications and equivalents are possible in view of the above teachings. Therefore, it is to be understood that the disclosure is not limited to the embodiments set forth in the above-described detailed description. Accordingly, the true technical scope of the disclosure should be defined by the technical spirit of the appended claims. It is also be understood that the disclosure covers all modifications, equivalents and alternatives falling within the spirit and scope of the disclosure as defined by the appended claims.

EXPLANATION OF NUMERALS

10: Band
20: Fastening piece
30: Body part
11: Fastening hole
21: Connecting rod
22: First fastening protrusion
23: Second fastening protrusion
24: Third fastening protrusion
25: Cutoff slot

What is claimed is:

1. A teether with a wristband, the teether comprising:
a band which has a cutout portion to allow the wrist of an infant to pass therethrough, and has a fastening hole at one end;
a fastening piece which has connecting rods and fastening protrusions alternately provided from the other end of the band, extends to be bent at least once, and is engaged by passing through the fastening hole to close the band; and
a body part which is formed to extend upward from the band to be sucked, chewed and gnawed by the infant, wherein
at least one of the fastening protrusions has a cutoff slot so as to induce elastic deformation of the fastening piece and thus avoid twist deformation in the band when the fastening piece is engaged with the fastening hole.

2. The teether with a wristband of claim 1, wherein:
the fastening protrusions comprise a first fastening protrusion disposed at a given interval from the other end of the band, and
a second fastening protrusion disposed at the given interval up from the first fastening protrusion; and
the cutoff slot is formed in the first fastening protrusion.

3. The teether with a wristband of claim 2, wherein:
the fastening protrusions further comprise a third fastening protrusion disposed at the given interval in front of the second fastening protrusion; and
the first fastening protrusion, the second fastening protrusion, and the third fastening protrusion are mutually arranged in an upside-down "L" shape.

4. The teether with a wristband of claim 2, wherein:
the fastening protrusions further comprise a third fastening protrusion disposed at the given interval up from the second fastening protrusion, and at least one among the second fastening protrusion and the third fastening protrusion is made to be eccentric on a vertical line of the first fastening protrusion such that the fastening piece has a certain inclined angle.

5. The teether with a wristband of claim 1, wherein:
the cutoff slot of the at least one of the fastening protrusions is cut off facing outward from the center of the corresponding fastening protrusion among the at least one of the fastening protrusions.

6. The teether with a wristband of claim 1, wherein:
the fastening hole is integrally formed with a through-section through which a corresponding fastening protrusion passes and an extension section which extends from the through-section so that the through-section can extend in accordance with the size of the corresponding fastening protrusion among the at least one of the fastening protrusions.

* * * * *